US009717284B2

(12) United States Patent
Misseldine

(10) Patent No.: US 9,717,284 B2
(45) Date of Patent: Aug. 1, 2017

(54) BRASSIERE

(71) Applicant: Jeanette Misseldine, Hertfordshire (GB)

(72) Inventor: Jeanette Misseldine, Hertfordshire (GB)

( * ) Notice: Subject to any disclaimer, the term of this patent is extended or adjusted under 35 U.S.C. 154(b) by 217 days.

(21) Appl. No.: 14/434,554

(22) PCT Filed: Oct. 14, 2013

(86) PCT No.: PCT/GB2013/052675

§ 371 (c)(1),
(2) Date: Apr. 9, 2015

(87) PCT Pub. No.: WO2014/057288

PCT Pub. Date: Apr. 17, 2014

(65) Prior Publication Data

US 2015/0272232 A1 Oct. 1, 2015

(30) Foreign Application Priority Data

Oct. 12, 2012 (GB) ..... 1218390.1

(51) Int. Cl.
*A41C 3/00* (2006.01)

(52) U.S. Cl.
CPC ..... *A41C 3/0007* (2013.01)

(58) Field of Classification Search
CPC ..... A41C 3/00; A41C 3/00007; A41C 3/148; A41C 3/0028
See application file for complete search history.

(56) References Cited

U.S. PATENT DOCUMENTS 2,481,603 A * 9/1949 Cascio ..... A41C 3/00 450/75
2,628,357 A 2/1953 Sider
3,699,971 A * 10/1972 Hittel ..... A41C 3/0028 450/3
4,314,054 A * 2/1982 Acton ..... C07H 15/252 514/908
4,372,322 A * 2/1983 Stern ..... A41C 3/0028 450/67

(Continued)

FOREIGN PATENT DOCUMENTS

EP 1 060 678 A2 12/2000

OTHER PUBLICATIONS

Espacenet, English Machine Translation of EP1060678A2, published Dec. 20, 2000, retrieved from http://worldwide.espacenet.com on Apr. 6, 2015 (5 pages).

(Continued)

*Primary Examiner* — Gloria Hale
(74) *Attorney, Agent, or Firm* — Wood Herron & Evans LLP

(57) ABSTRACT

A brassiere comprising a wing having a top edge and a bottom edge, at least one strap and at least one cup for receiving a breast, the cup having an around cup edge section, an underarm edge section, a neckline edge section and an apex, the around cup section of the cup having a wire, wherein the brassiere further comprises a control panel generally extending from the apex of the cup into the wing, the control panel having an upper edge and a lower edge and wherein the wire terminates proximal to the lower edge of the control panel.

14 Claims, 13 Drawing Sheets

(56) References Cited

U.S. PATENT DOCUMENTS

| | | | | | |
|---|---|---|---|---|---|
| 4,393,875 | A * | 7/1983 | O'Boyle | A41C 3/0028 | 33/12 |
| 4,444,192 | A | 4/1984 | Stern et al. | | |
| 4,453,549 | A * | 6/1984 | DiTullio | A41C 3/00 | 450/74 |
| 4,470,419 | A * | 9/1984 | DiTullio | A41C 3/00 | 450/19 |
| 4,655,224 | A * | 4/1987 | Stern | A41C 3/00 | 450/36 |
| 5,045,019 | A * | 9/1991 | Capasso | A41C 3/00 | 2/73 |
| 5,167,566 | A * | 12/1992 | Novitsky | A41C 3/00 | 2/67 |
| 5,215,494 | A * | 6/1993 | Flanagan | A41C 3/148 | 2/73 |
| 6,485,352 | B1 | 11/2002 | Batcha et al. | | |
| 2003/0082994 | A1* | 5/2003 | Mitchell | A41C 3/0007 | 450/74 |

OTHER PUBLICATIONS

European Patent Office, International Search Report and Written Opinion of the International Searching Authority, International Application No. PCT/GB2013/052675, mailed on Dec. 12, 2013 (7 pages).

* cited by examiner

BRASSIERE

CROSS-REFERENCE TO RELATED APPLICATIONS

This application is a submission under 35 U.S.C. §371 of International Application No. PCT/GB2013/052675, filed Oct. 14, 2013, which claims priority to Great Britain Application No. 1218390.1, filed Oct. 12, 2012, the disclosures of which are hereby expressly incorporated by reference herein in their entireties.

FIELD OF THE INVENTION

The present invention relates generally to brassieres and, more particularly to brassieres for fuller figured and plus size women.

BACKGROUND OF THE INVENTION

Fuller figured and plus size women generally have larger breasts that need to be supported. Thus brassieres for fuller figured and plus size women tend to be underwired in order to provide the required level of support for the larger breasts.

The problem is that as the size of the breast increases the length of the wire used in the underwire also increases. The wire of an underwired bra can thus end up being quite long in brassieres for fuller figured and plus size women. This often results in the underwire digging in to the body under the arms, or the bust of fuller figured and plus size women.

This problem is much worse in plus size women as the brassiere, being tight around the body to provide support, results in flesh being squeezed under the arms and overhang of this flesh above the brassiere results. Furthermore the underwire readily digs into this overhang of flesh resulting in a very painful experience as well as the unsightly overhang of flesh.

In some instances, although it should not normally happen, a smaller wire may have mistakenly been inserted into the underwire channel of a brassiere to eliminate the wire digging into the overhang of flesh, however, the overhang of flesh is still present, and the wire instead digs into the ribcage of the wearer which is equally as painful and can result in bruising. Furthermore the excess fabric of the bra can cause rubbing. One of the biggest problems is due to the machinist pulling on the fabric too much whilst sewing the garment together. When this occurs the channel becomes larger than the wire inserted into the channel. This difference in length between the channel and the wire is called wire play. Whilst some wire play is desired, typically between about 0.5 cm and 1.5 cm, to allow for shrinkage of the material through repeated washing, more wire play than this is undesirable as no support is provided for the wire and such that the wire digs into the flesh of the wearer at the same time as the excess rubs the flesh of the wearer.

The wearing of such uncomfortable brassieres can result in significant health problems such as mastalagia, maceration, intertrigo, bruising, vitiligo and fungal infections.

SUMMARY OF THE INVENTION

According to a first aspect of the present invention, there is provided a brassiere comprising a wing having a top edge and a bottom edge, at least one strap and at least one cup for receiving a breast, the cup having an around cup edge section, an underarm edge section, a neckline edge section and an apex, the around cup section of the cup having a wire, wherein the brassiere further comprises a control panel generally extending from the apex of the cup into the wing, the control panel having an upper edge and a lower edge and wherein the wire terminates proximal to the lower edge of the control panel. Preferably the control panel is a multiflex control panel.

Preferably the distance between the upper edge and lower edge of the control panel is between about 2.5 cm to 8 cm.

Preferably the distance between the upper edge and lower edge of the control panel is between about 3 cm to 6 cm.

Preferably the distance between the upper edge and lower edge of the control panel is about 4 cm.

Preferably the distance between the upper edge and lower edge of the control panel is measured substantially vertically from the point where the wire terminates proximal to the lower edge of the control panel.

Preferably the control panel is elasticated. Preferably the control panel comprises an active elastic strip.

Preferably the control panel comprises a first elastic strip configured to control the force of the end of the wire. Preferably the first elastic strip comprises a first active elastic strip.

In one alternative the first elastic strip is configured to control the force of the end of the wire towards the apex and the wing.

In another alternative the first elastic strip is configured to control to force of the end of the wire towards the wing and away from the apex.

Preferably the first elastic strip extends substantially across the point where the wire terminates.

Preferably the first elastic strip extends substantially from the apex of the cup to the bottom edge or around the wing.

Preferably the first elastic strip extends substantially along the lower edge of the control panel.

In an alternative the first elastic strip extends substantially from the end of the wire to the bottom edge or around the wing.

Preferably the control panel comprises a second elastic material strip extending substantially from the apex of the cup along the underarm edge section of the cup to the top edge of the wing. Preferably the second elastic strip comprises a second active elastic strip.

Preferably the control panel comprises a second elastic material strip extending substantially along the upper edge of the control panel.

Preferably the strap is connectable to the cup.

Preferably the strap is connectable to the apex of the cup.

According to a second aspect of the present invention there is provided a brassiere comprising a wing having a top edge and a bottom edge, at least one strap and at least one cup for receiving a breast, the cup having an around cup edge section, an underarm edge section, a neckline edge section and an apex, the around cup edge section of the cup having a wire, wherein the wire does not extend around the full extent of the around cup edge section and the around cup edge section comprises a control panel extending the remaining extent of the around cup edge section. Preferably the control panel is a multiflex control panel.

Preferably the control panel comprises about 2.5 cm to 8 cm of the around cup edge section.

Preferably the control panel comprises about 3 cm to 6 cm of the around cup edge section.

Preferably the control panel comprises about 4 cm of the around cup edge section.

Preferably the control panel is elasticated. Preferably the control panel comprises an active elastic strip.

Preferably the control panel comprises a first elastic strip configured to control the force of an end of the wire. Preferably the first elastic strip comprises a first active elastic strip.

In one alternative the first elastic strip is configured to control the force of the end of the wire towards the apex and the wing.

In another alternative the first elastic strip is configured to control to force of the end of the wire towards the wing and away from the apex.

Preferably the first elastic strip extends substantially across the top of the wire.

Preferably wherein the first elastic strip extends substantially from the apex of the cup to the bottom edge of the wing.

In an alternative the first elastic strip extends substantially from the end of the wire to the bottom edge or around the wing.

Preferably the control panel comprises a second elastic material strip extending substantially from the apex of the cup along the underarm edge section of the cup to the top edge of the wing. Preferably the second elastic strip comprises a second active elastic strip.

Preferably the strap is connectable to the cup.

Preferably the strap is connectable to the apex of the cup.

The multiflex control panel preferably comprising an active elastic strip advantageously provides for the first time a brassiere that smoothes out the flesh of plus sized women, by eliminating flesh overhang by supporting the underarm area with a wire sitting lower on the body of the wearer whilst simultaneously using the elasticated control panel which means that the wire does not intrude into the rib cage of the wearer and which also provides additional side bust support. Furthermore, since many wearers get their bra size incorrect either by choosing incorrectly themselves or by being ill advised by so called professionals, the fact that the wire sits lower on the body results in less discomfort for the wearer as the wire will not be too long for the rib cage even in an incorrectly fitting bra.

The control panel supports excess underarm flesh to deliver a smooth body line without any discomfort to the wearer. In one alternative the control panel comprises a rigid fabric on the front and a stretchable or elasticated fabric on the back.

The elastic in the control panel is preferably hidden to prevent the elastic from turning and rolling which can result in chaffing. In the alternative the elastic in the control panel may be visible. The designer in some instances may prefer the elastic to be visible for aesthetic reasons in the design. Whether or not the elastic is visible does not affect the functional benefits of the control panel.

The wire sitting lower on the body of the wearer than in traditional prior art bras means that the wire no longer intrudes into the bust and underarm sitting snugly against the body of the wearer rather than protruding out at the front or side to support the lower bust but not penetrate the body cage.

The overall effect is to provide a brassiere that supports unattractive excess flesh previously enhanced by poorly fitting bras to give a brassiere with a smooth line that projects the bust forwards and upwards whilst remaining comfortable.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
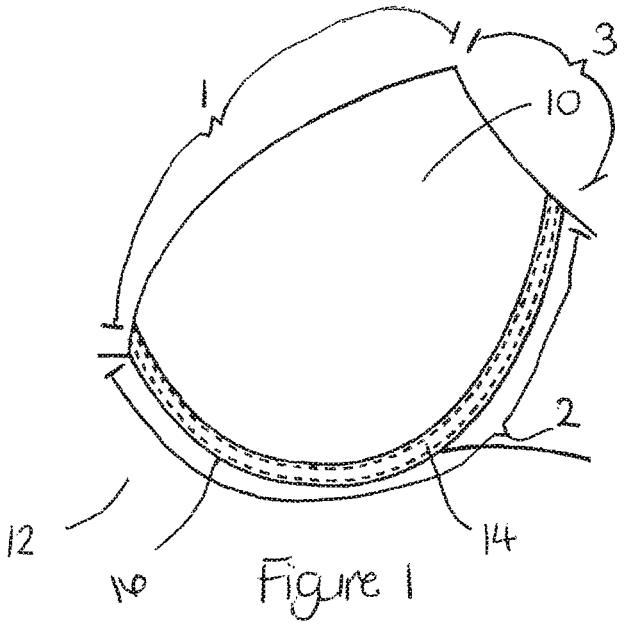
FIG. 1 illustrates a typical prior art underwired brassiere having a wire running the full distance under the cup.

FIG. 1 illustrates the cup 10 of a typical prior art brassiere 12. The cup 10 is provided with a wire 14 known as an underwire housed within the cup 10 in channel or wire casing 16.

A typical bra cup has three edge sections, the top edge section is called the neckline edge section 1, the lower edge where the underwire is normally located is called the around cup edge section 2 and the section joining the neckline edge section 1 to the around cup edge section 2 is called the underarm edge section 3. These three sections have been illustrated in FIG. 1 for ease of reference.

Figure 2:
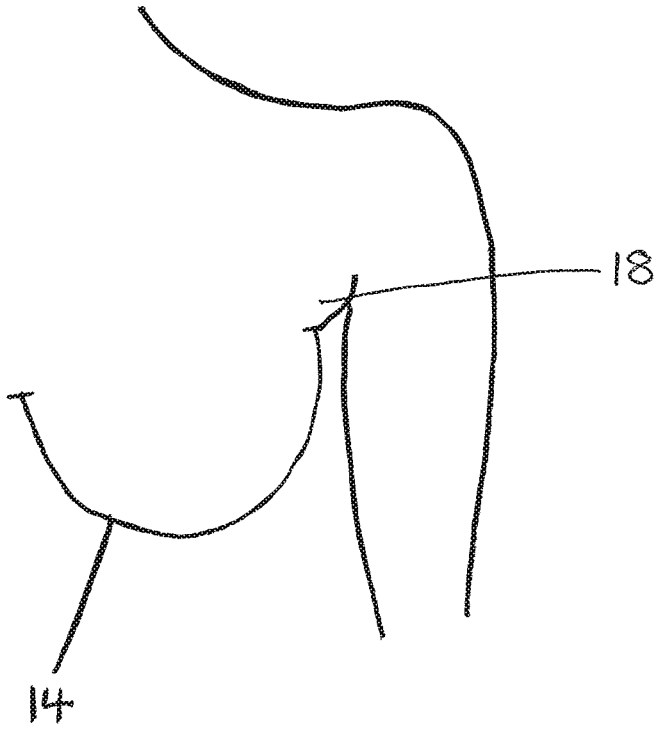
FIG. 2 illustrates the problem of the wire in typical prior art underwired brassieres digging in under the arm.

FIG. 2 illustrates the location of the wire 14 on a fuller figured woman without the rest of the brassiere being visible. It is readily visible where the wire 14 digs in under the arm at point 18 on a fuller figured woman.

Figure 3A:
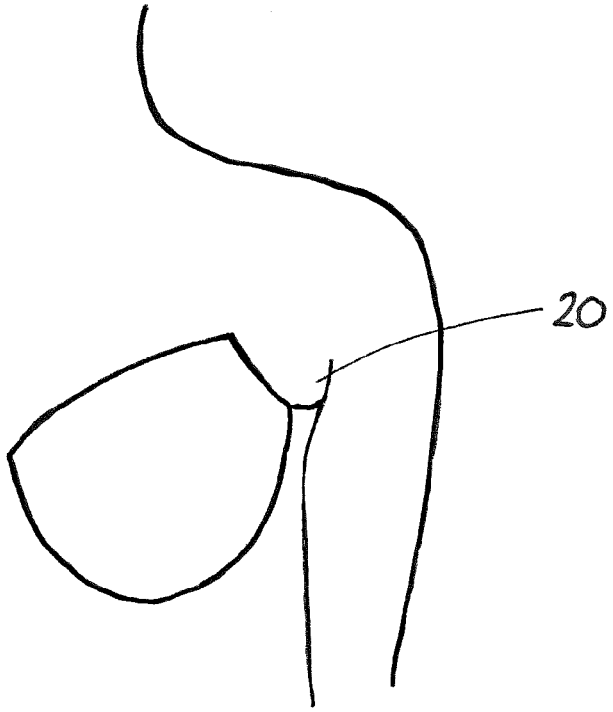
FIG. 3*a* illustrates the problem of overhang of flesh over the top of the brassiere under the arm from the front.
Figure 3B:
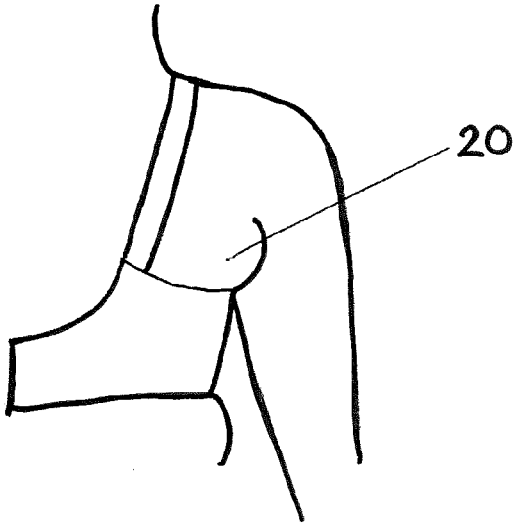
FIG. 3*b* illustrates the problem of overhang of flesh over the top of the brassiere under the arm from the rear.

FIGS. 3*a* and 3*b* illustrate the front and rear views of a typical prior art brassiere on a plus size woman. It is readily visible where the overhang of flesh occurs under the arm at point 20 both from the front and rear.

Figure 4:
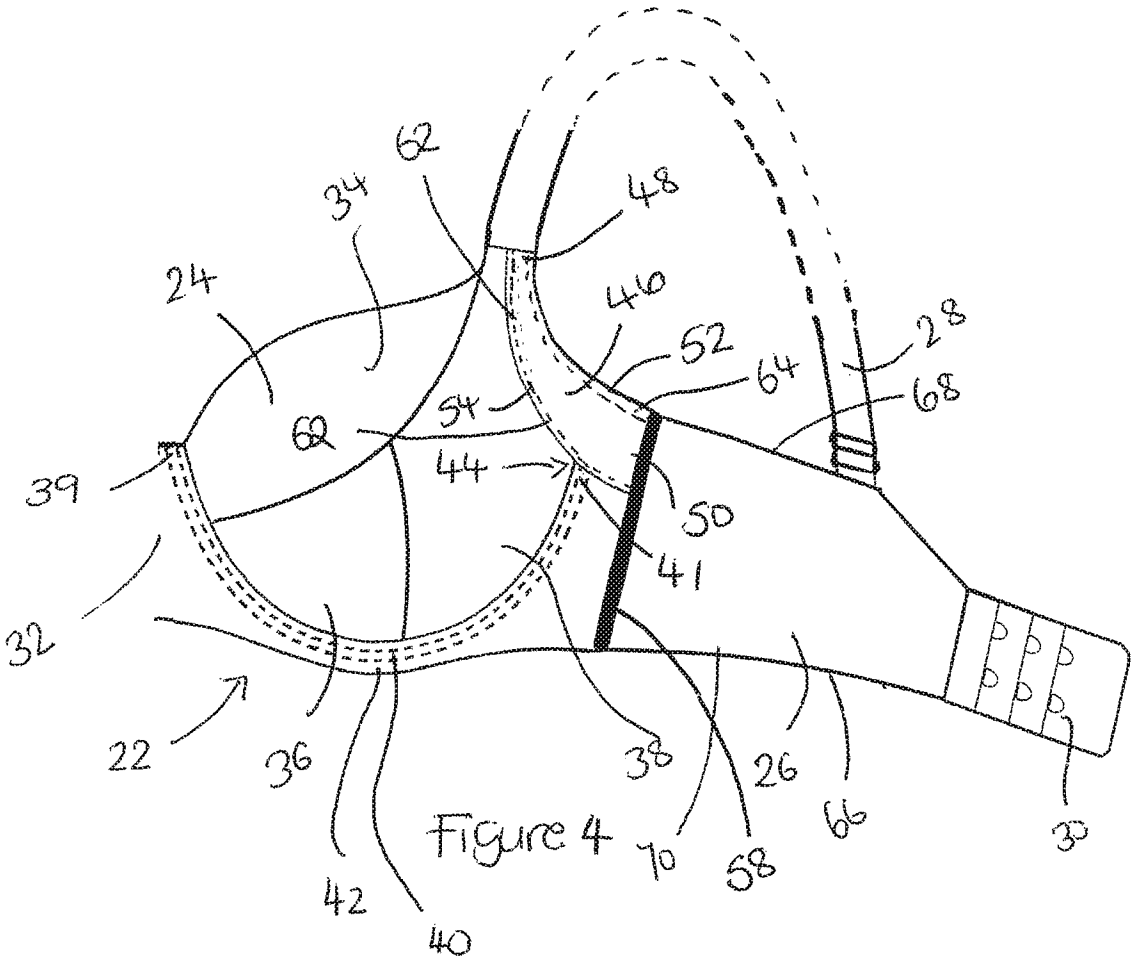
FIG. 4 illustrates a front view of an underwired brassiere of the present invention.
Figure 5:
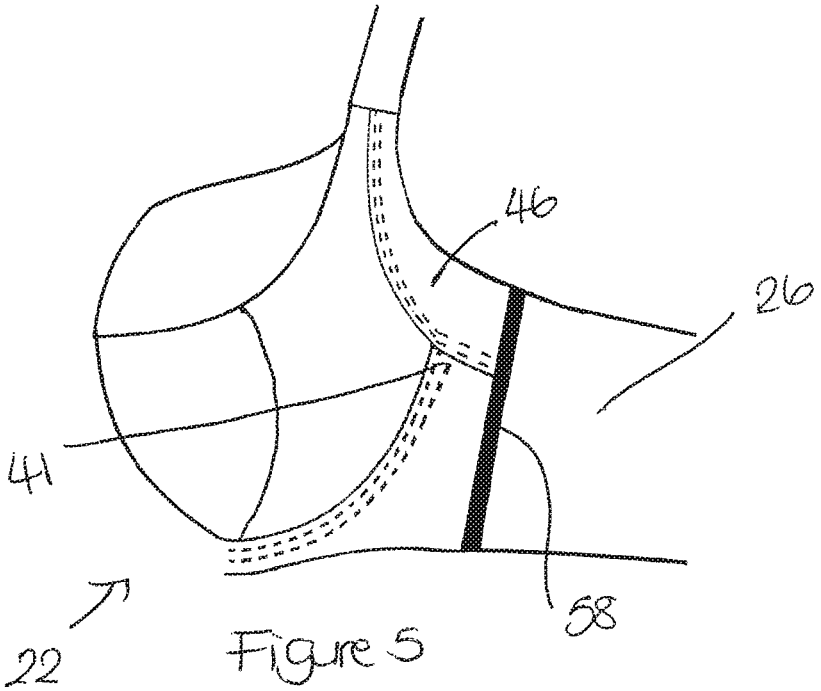
FIG. 5 illustrates a side view of an underwired brassiere of the present invention.
Figure 6:
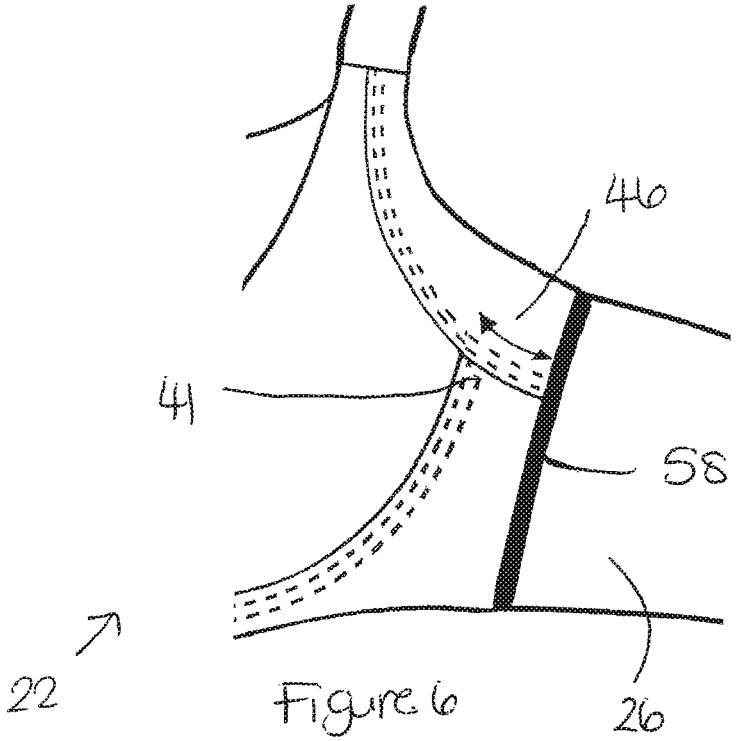
FIG. 6 illustrates a close up view of the key components of an underwired brassiere of the present invention.

FIGS. 4 to 6 illustrate a portion of a brassiere 22 according to an embodiment of the present invention. The brassiere 22 has two cups 24 (only one of which is visible in this figure) to hold the breasts, a wing 26 (only half of which is visible in this figure) that wraps around the wearer's torso and two shoulder straps 28 (only one of which is visible in this figure). In the embodiment illustrated the wing 26 is closed in at the back by a hook and eye fastener system 30, however in an alternative embodiment the fastening may occur at the front in the gore 32 (i.e., the section between the cups at the front). The type of fastener system is not limited to a hook and eye fastener system, this is simply the fastener system most commonly used in brassieres. Further in the alternative the wing 26 may not be provided with an opening and may simply be a continuous band which the user positions in place by pulling the brassiere on over the head for example in the case of some sleep bras, sports bras or athletic bras. Yet further in the alternative the straps 28 may cross over at the back, be of halter neck construction, be removable or be of any other suitable construction. The type of strap 28 is not essential to the present invention. The strap 28 may be in one alternative connected to the cup at the apex of the cup, in a further alternative at the underarm section and in yet a further alternative between the two cups at the front of the brassiere. The location of the strap 28 connection is not essential to the present invention. The cup 24 of the brassiere is typically formed from three panels 34, 36, 38 to provide additional support for fuller figured and plus size women. The construction of the cup 24 is not essential to the present invention, and may in the alternative be formed from only two panels or be of seamless or moulded construction for example in the case of a preformed foam cup.

The brassiere 22 includes a wire 40 having a first end 39 and a second end 41 housed in a channel or wire casing 42. Unlike in typical prior art brassieres such as that illustrated in FIG. 1, the wire 40 does not extend around the full extent of the around cup edge section 2, and the second end 41 stops about 4 cm lower on the body of the wearer in use and thus the brassiere at point 44 leaving a section of the around cup edge section 2 that is not wired between an end of the wire and the underarm edge section 3. The wire 40 typically does not extend for the full length of the channel 42. There is usually a small amount of wire play of between about 0.5 cm and 1.5 cm to allow for shrinkage of the fabric and bending or movement of the wire 40 caused by washing. This means that the first and second ends 39, 41 of wire 40 do not rub against the ends of the channel 42. This means that the channel 42 is typically between about 0.5 cm and 1.5 cm longer than the wire 40. This feature is also present in standard prior art brassieres as discussed in the background of the invention. The channel 42 also does not extend the full extent of the around cup 24 and also stops about 4 cm lower on the body, and thus also on the bra at point 44.

Figure 11A:
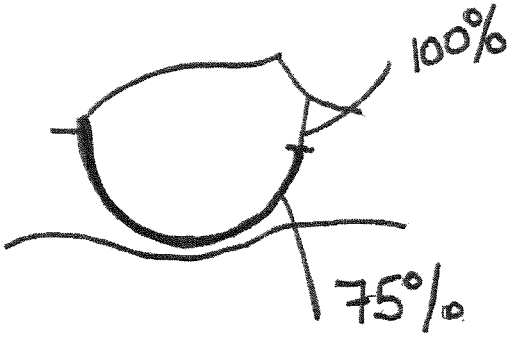
FIGS. 11*a* to 11*c* illustrate the extent the wire extends around the around cup edge section compared with typical prior art brassieres.

In a typical balconette style bra the wire typically extends around about 100% of the around cup edge section in a prior art bra, whereas in the present invention the wire typically extends around about 75% of the around cup edge section and thus the breast, i.e., about 4 cm lower on the body under the arms of the wearer than a prior art bra as illustrated in FIG. 11*a*.

Figure 11B:
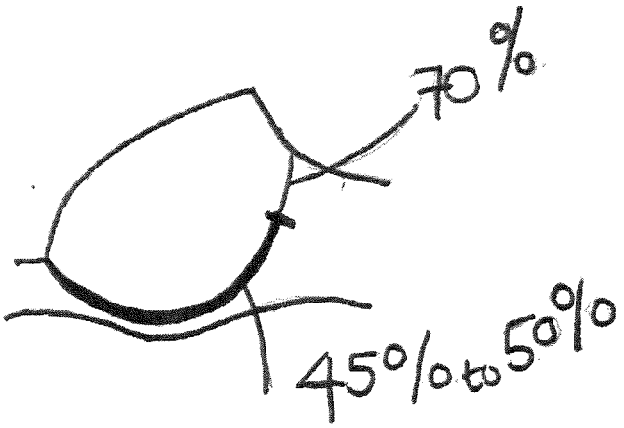

In a typical plunge style bra the wire typically extends around about 70% of the around cup edge section in a prior art bra, whereas in the present invention the wire typically extends around about 45% to 50% of the around cup edge section, i.e., about 4 cm lower on the body under the arms of the wearer than a prior art bra as illustrated in FIG. 11*b*.

Figure 11C:
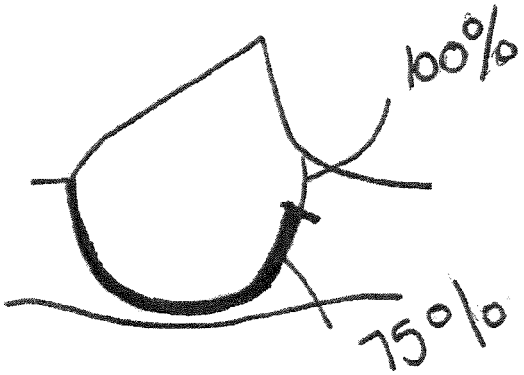

In a typical full cup or athletic style bra the wire typically extends around about 100% of the around cup edge section in a prior art bra, whereas in the present invention the wire typically extends around about 75% of the around cup edge section, i.e., about 4 cm lower on the body under the arms of the wearer than a prior art bra as illustrated in FIG. 11*c*.

As the second end 41 of the wire 40 is located below the top of the side of the bra, the second end 41 or the wire 40 would at this point be free to curve and stick into the ribcage of the wearer. Thus the second end 41 of the wire 40 ideally needs to be supported so that this does not occur.

Figure 7:
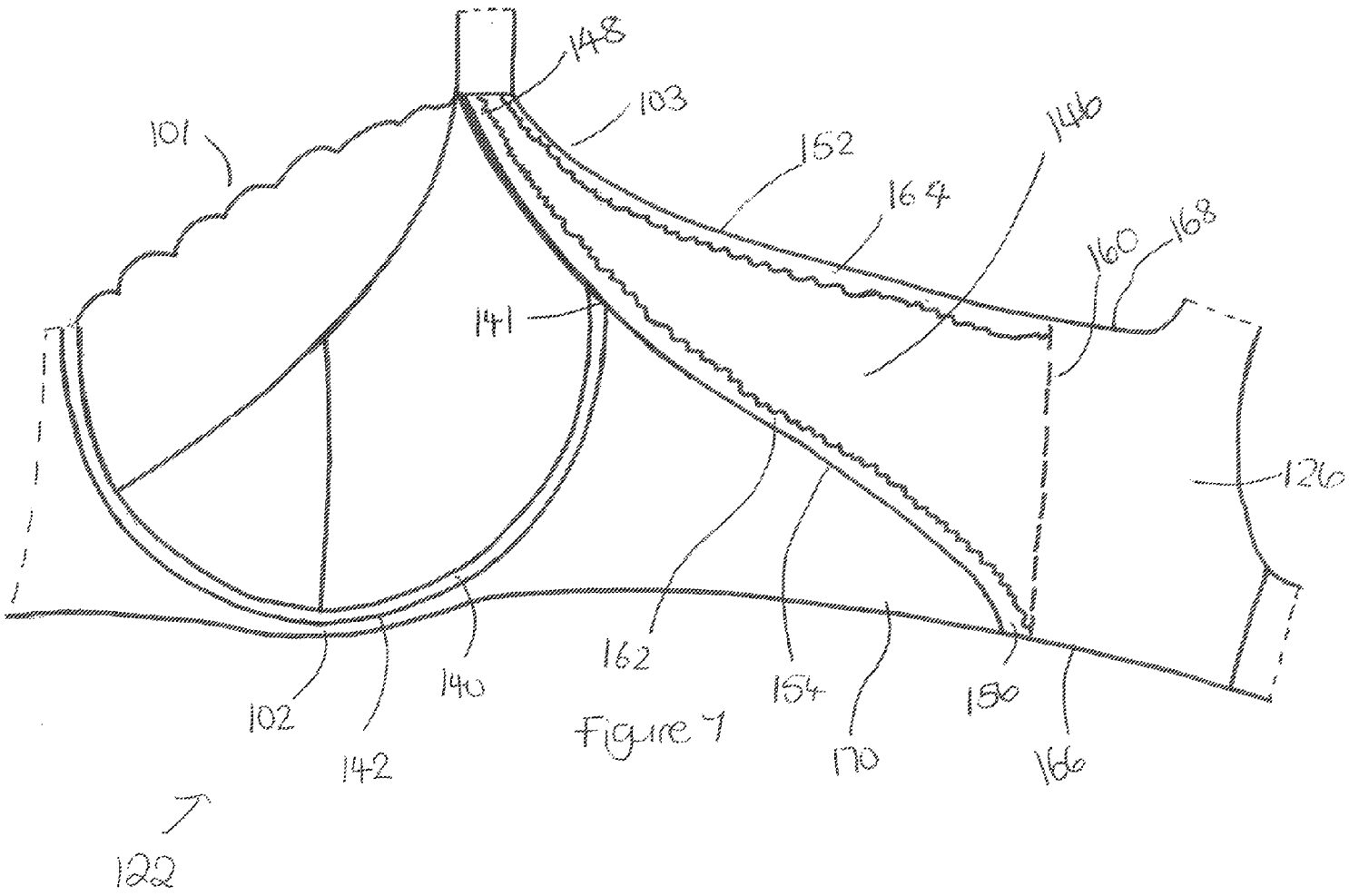
FIG. 7 illustrates a front view of an alternative underwired brassiere of the present invention.

Thus the brassiere 22 further ideally includes a control panel 46. In one alternative the control panel is a multiflex control panel. The section of the around cup edge section 2 that is not wired includes the control panel 46. The control panel 46 extends generally vertically for the remaining distance from the second end 41 of the wire 40 and channel 42 to the top of the underarm edge section 3 of the brassiere, i.e., the extent of the around cup edge section 2 that is not wired. The control panel 46 is free from wire 40. The control panel 46 extends generally horizontally from the apex or shoulder strap joining point 48 along the underarm edge section 3 to the wing joining point 50 where bone 58 is located as illustrated in FIG. 4. In an alternative embodiment the control panel 146 extends along the underarm edge section 103 and extends into and becomes the wing 126 as illustrated in FIG. 7 and as such no bone is required. In either alternative the control panel 46, 146 is generally formed from an elasticated material such as nylon LYCRA® mesh construction, which may be double or single layered, in one or more materials. In one alternative the control panel 46, 146 is formed from a rigid material inside on the front and a stretchable or elasticated material at the back. The control panel 46, 146 is also provided with a first strong elastic strip 62, 162 extending along lower edge 54, 154 of the control panel 46, 146. The first strong elastic strip 62, 162 extends from apex 48, 148 down towards the second end 41, 141 of wire 40, 140 and channel 42, 142 and extending substantially perpendicular thereto at the point where the second end 41, 141 of wire 40, 140 and channel 42, 142 meets the elastic strip 62, 162 and then continuing to extend down towards the bottom edge 66, 166 of wing 26, 126 stopping at bone 58 in the case of the embodiment illustrated in FIG. 4 or continuing down to meet the bottom edge 166 of wing 126. In one alternative the first strong elastic strip comprises an active elastic strip. The control panel 46, 146 is also provided with a second strong elastic strip 64, 164 along upper edge 52, 152 extending along the top of the brassiere from apex 48, 148 along the underarm edge section 2, 102 and into the top edge 68, 168 of wing 26, 126, as well as the standard strong elastic strip 70, 170 running along the bottom edge 66, 166 of the wing 26, 126. In one alternative the second strong elastic strip comprises an active elastic strip. The control panel 46, 146 is generally triangular in shape with a first point of the triangle being found at the apex 48, 148 of the cup and with first and second edges of the triangle corresponding to the elastic strips 62, 64, 162, 164 and the third edge of the triangle corresponding to the bone 58 as in FIG. 4 or where the control panel 146 meets the wing 126 as in FIG. 7. Preferably the control panel 46, 146 is double skinned wherein the outer layer is nylon microfiber LYCRA® and the inner layer is a micro brushed mesh. The strong elastic strips 62, 64, 70, 162, 164, 170 may be hidden or may be visible. Preferably the strong elastic strips 62, 70, 162, 170 are hidden to prevent the elastic from turning and irritating the skin, in the alternative the elastic strips are visible. In the alternative illustrated in FIG. 7 the strong elastic strip 162 along lower edge 154 runs the full length from the apex or shoulder strap joint 148 to the lower edge 156 of wing 126. The strong elastic strip 62, 162 along lower edge 54, 154 acts to hold the second end 41, 141 of the wire 40, 140 away from the body of the wearer in use such that the wire 40, 140 not only does not dig into any overhang, but also does not dig into the ribcage of the wearer. In a further alternative shown in FIG. 8 the strong elastic strip 262*a*, 262*b* along lower edge 254*a*, 254*b* runs around substantially the centre of the wing 226 in a number of optional positions, based on the preference of the designer as to the position.

The fact that the control panel 46, 146 itself is made from an elasticated material in combination with the stiffer elastic along upper edge 52, 152 helps to support any excess flesh present under the arm without squashing the flesh to reduce or even eliminate any overhang of the flesh which would be present in prior art brassieres. In the embodiment illustrated in FIG. 4 a bone 58 is ideally required to assist in keeping the second end 41 of the wire 40 away from the body of the wearer, the strong elastic strip along lower edge 54 transfers the force to the bone 58. However, no bone is needed in the embodiment illustrated in FIG. 7 as the force is transferred to the bottom edge of the wing 126 directly as the stiff elastic strip 162 runs the full length thereto. The same is true in the embodiment illustrated in FIG. 8 wherein the force is transferred around the wing 226.

In the alternative shown in FIG. 7 the strong elastic strip 162 runs from the top edge of the brassiere at point 148 to the lower edge of the brassiere at point 156 effectively transferring the inward force of the second end 141 of wire 140 effectively away from the second end 141 of wire 140 to the edges of the brassiere, which need to be firm against the wearer of the brassiere.

Figure 9:
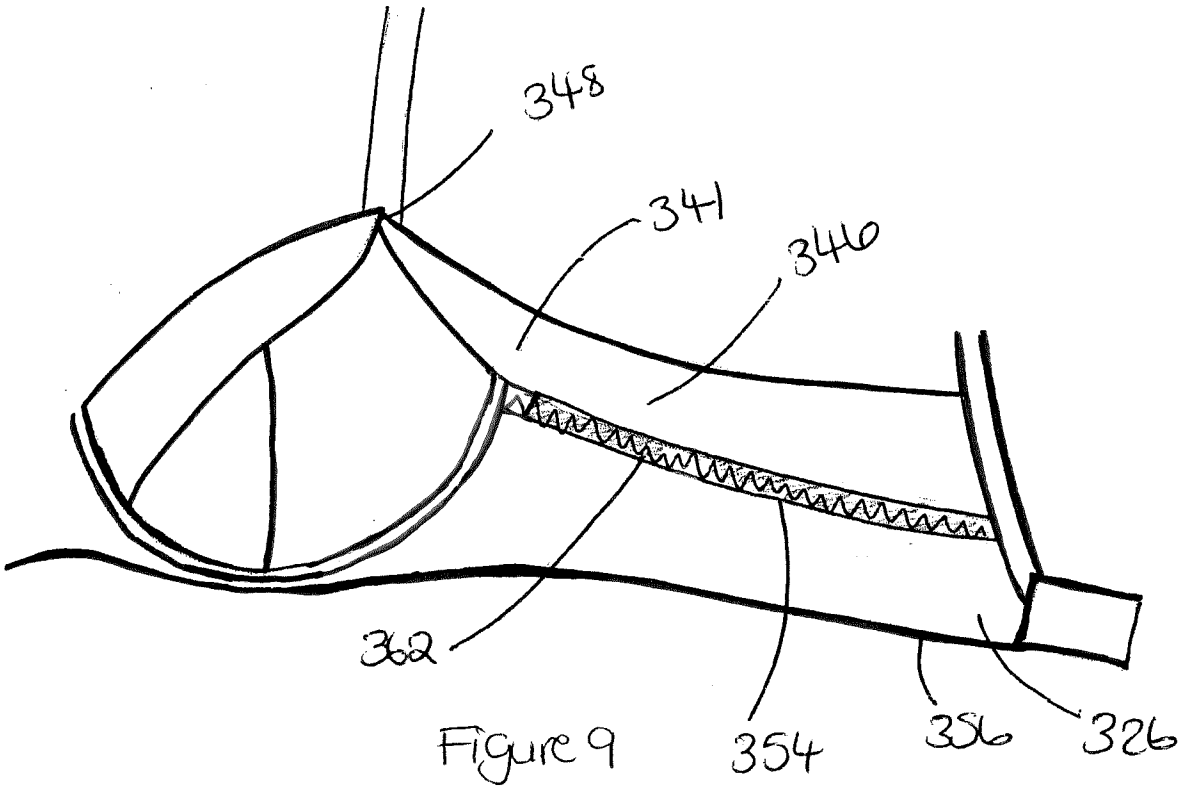
FIG. 9 illustrates a front view of another alternative underwired brassiere of the present invention.

In another alternative shown in FIG. 9 the strong elastic strip 362 does not run along the full length of the lower edge 354 of control panel 346 from the apex or shoulder strap joint 348 to the lower edge 356 or around the wing 326. Instead the strong elastic strip 362 runs from the second end of the wire 341 to the lower edge 356 or around the wing 326. In this alternative the amount of wire play created by the seamstress when creating the wire casing is irrelevant and the second end of the wire 341 is always held away from the body of the wearer.

The brassiere itself may be made according to any known style such as balconette, plunge, full cup or athletic and as such may be made from standard materials such as microfiber, nylon LYCRA®, cotton or any other suitable material. In a further alternative the brassiere may not be an undergarment, but may instead be swimwear. The elasticated material that control panel 46, 146 is made from may be in the alternative a standard material with some stretch provided with elastic such as nylon micro LYCRA®, cotton LYCRA® or any other suitable material to provide the control.

Figure 8:
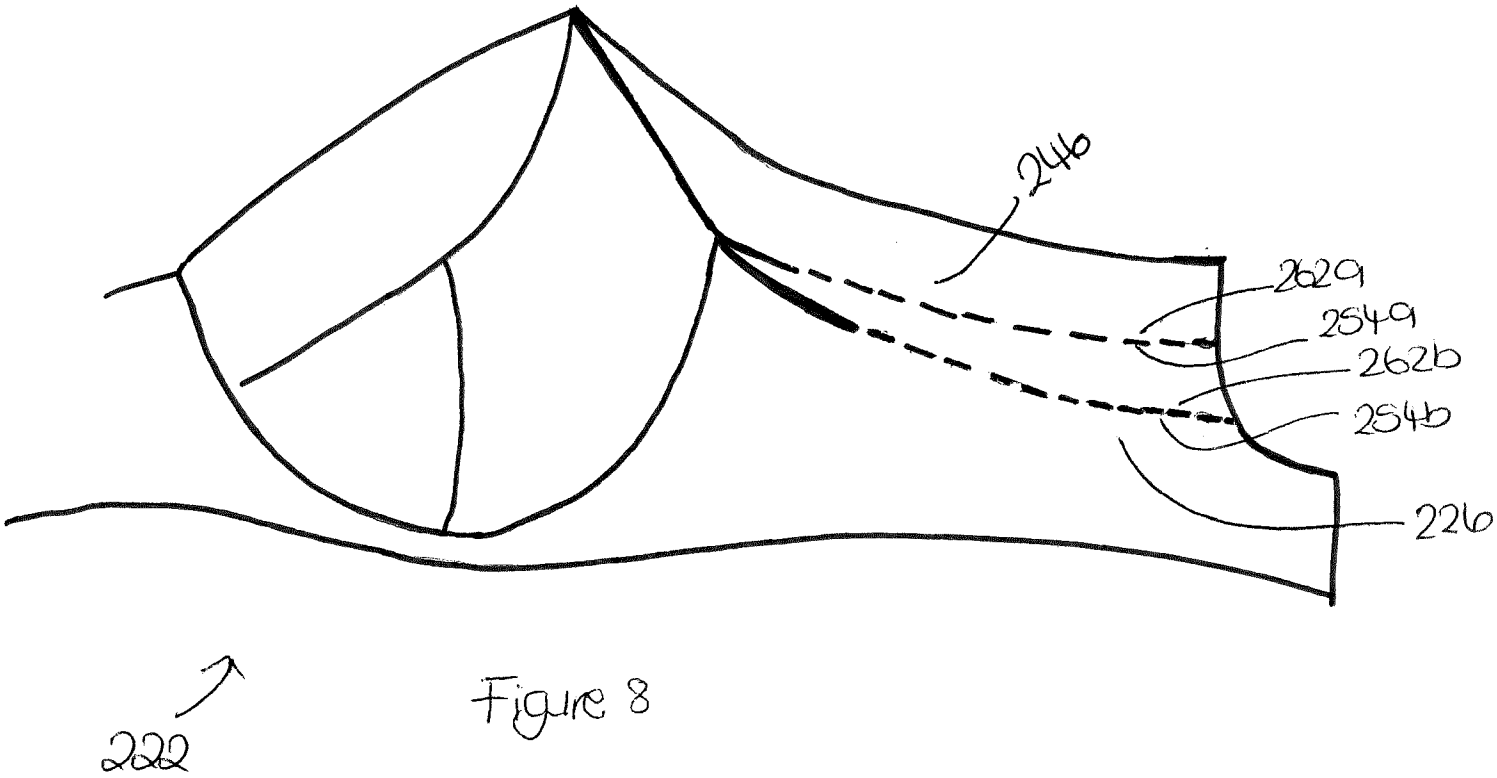
FIG. 8 illustrates a front view of a further alternative underwired brassiere of the present invention.
Figure 10:
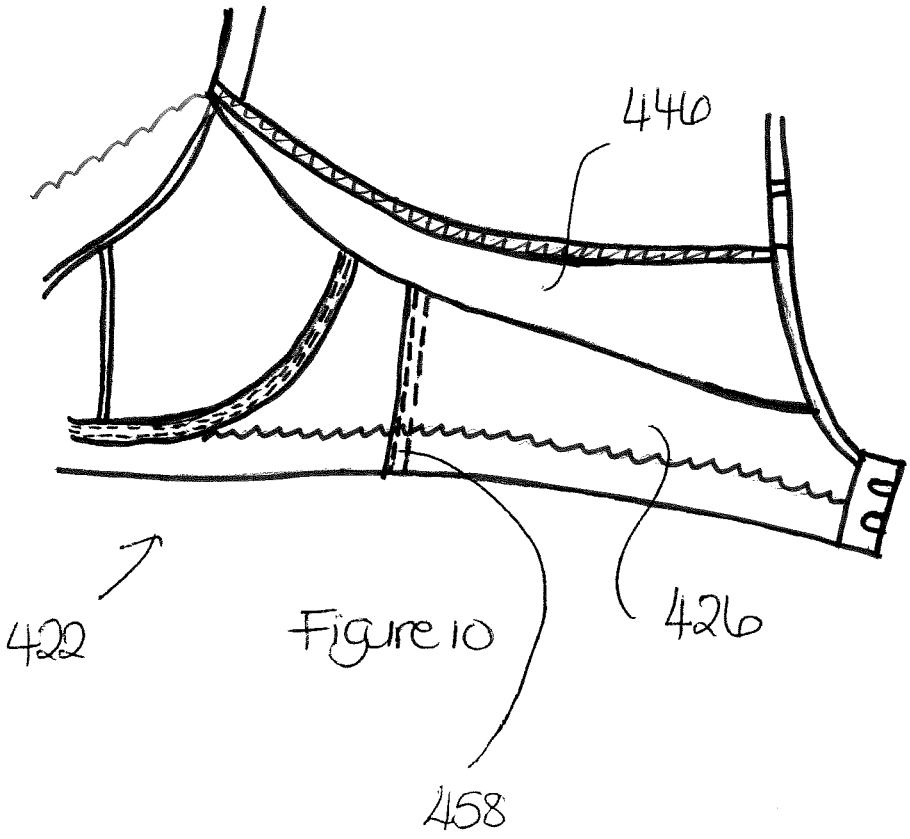
FIG. 10 illustrates a front view of a yet another alternative underwired brassiere of the present invention.

In a further alternative shown in FIG. 10 the brassiere 422 has a control panel 446 which extends into the wing 426 as per the embodiment illustrated in FIG. 8. In this embodiment though a seam or partial bone 458 is provided to provide additional support for larger cup sizes.

Figure 12A:
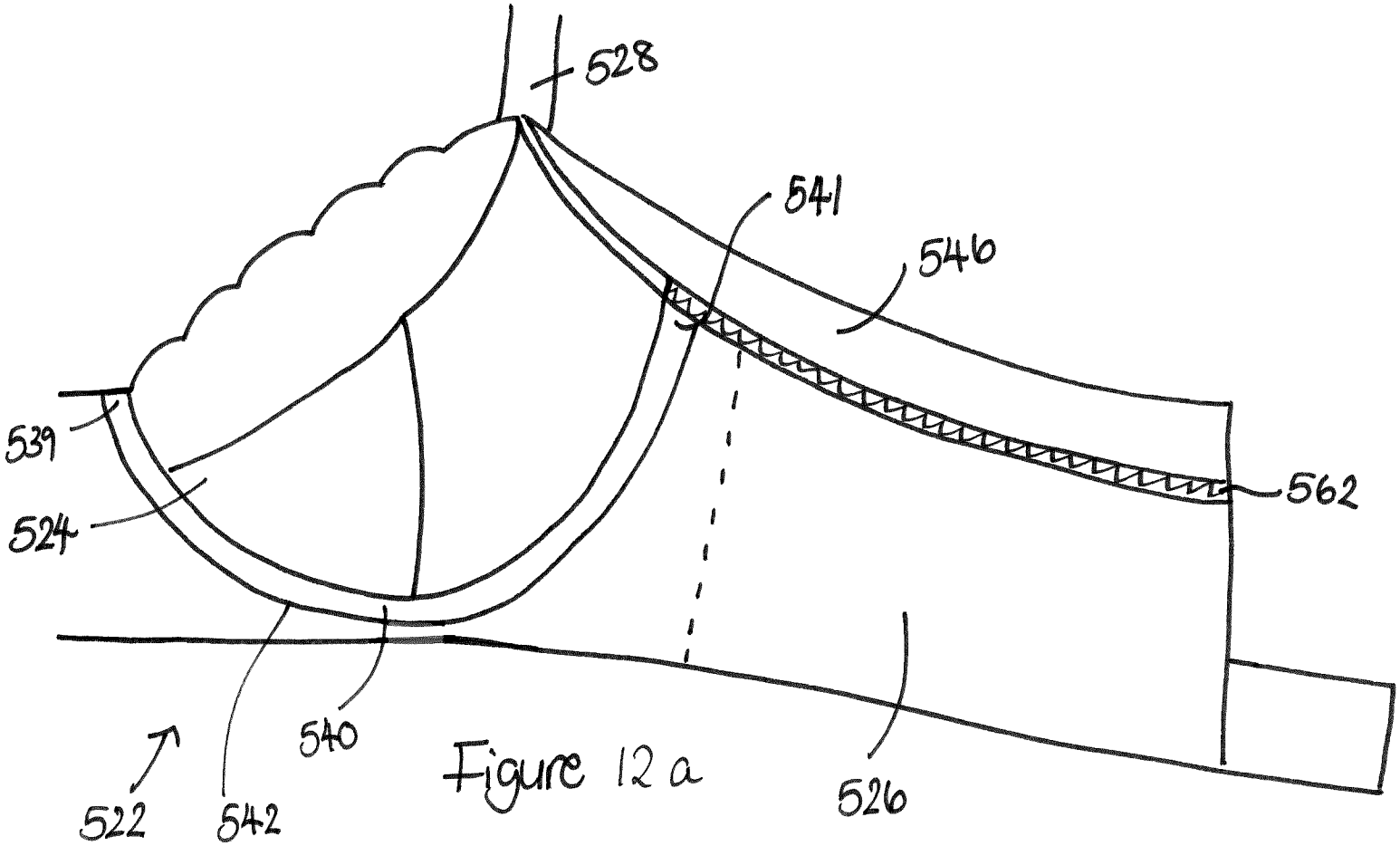
FIGS. 12*a* to 12*c* illustrate the alternative positions of the strong elastic in alternatives of the underwired brassiere of the present invention.
Figure 12B:
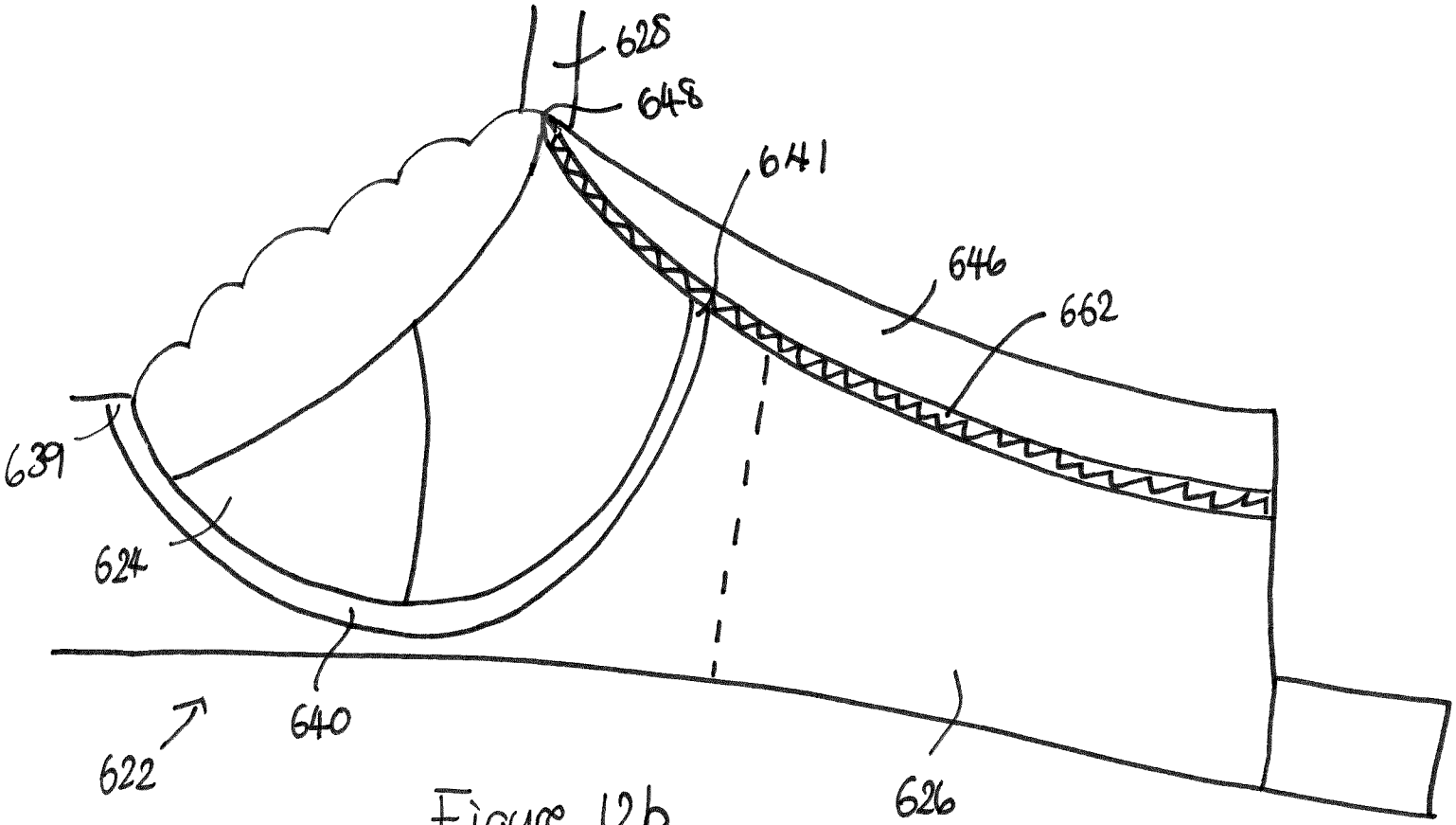
Figure 12C:
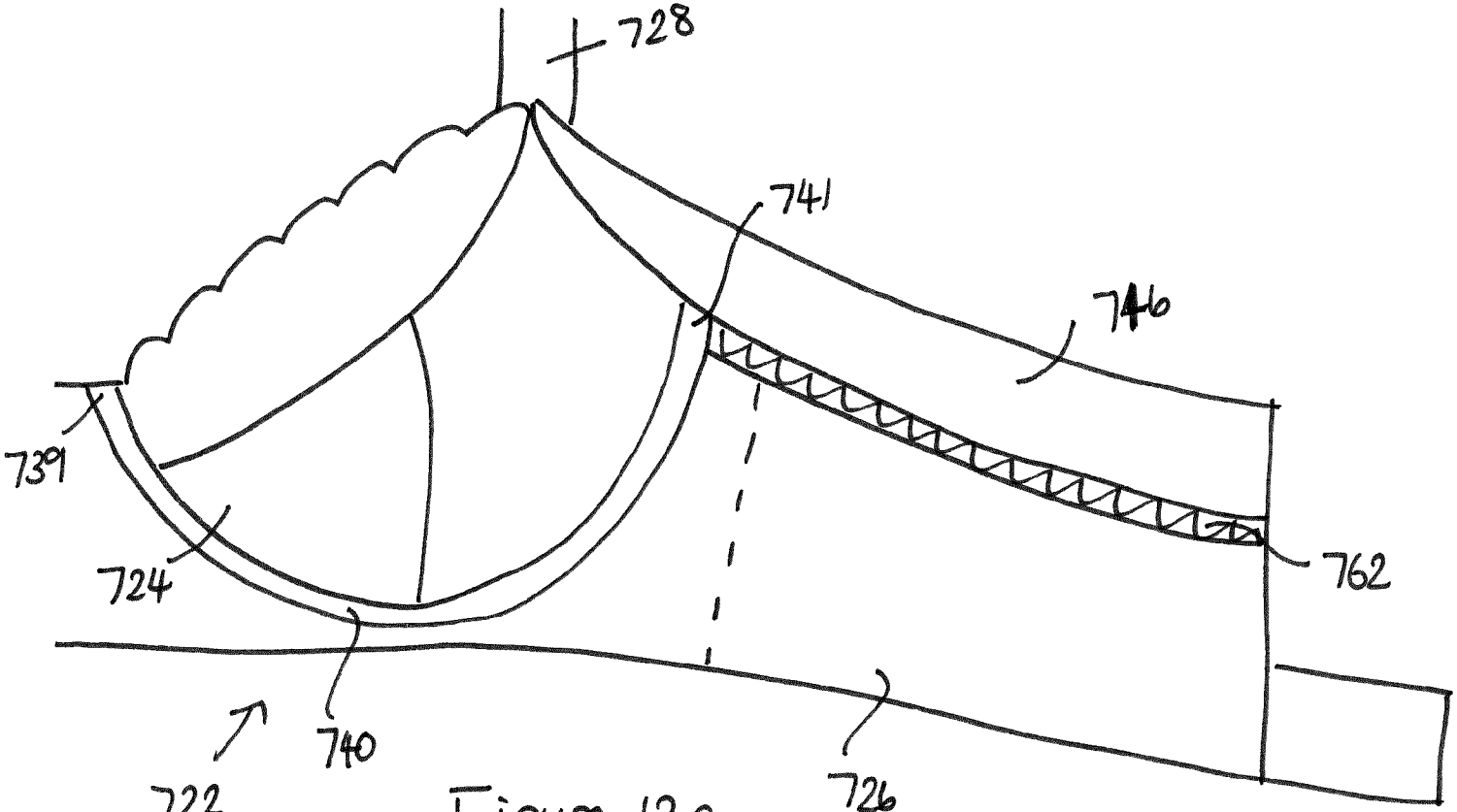

FIGS. 12*a* to 12*c* illustrate the alternative positions of the strong elastic in alternatives of the underwired brassiere of the present invention. FIG. 12*a* illustrates one alternative wherein strong elastic strip 562 is located in control panel 546 and begins at second end 541 of wire 540. FIG. 12*b* illustrates another alternative wherein strong elastic strip 662 is located in control panel 646 and begins at apex 648 and extends along second end 641 of wire 640. FIG. 12*c* illustrate another alternative wherein strong elastic strip 762 is located in wing 726 and begins at second end 741 of wire 740.

Figure 13:
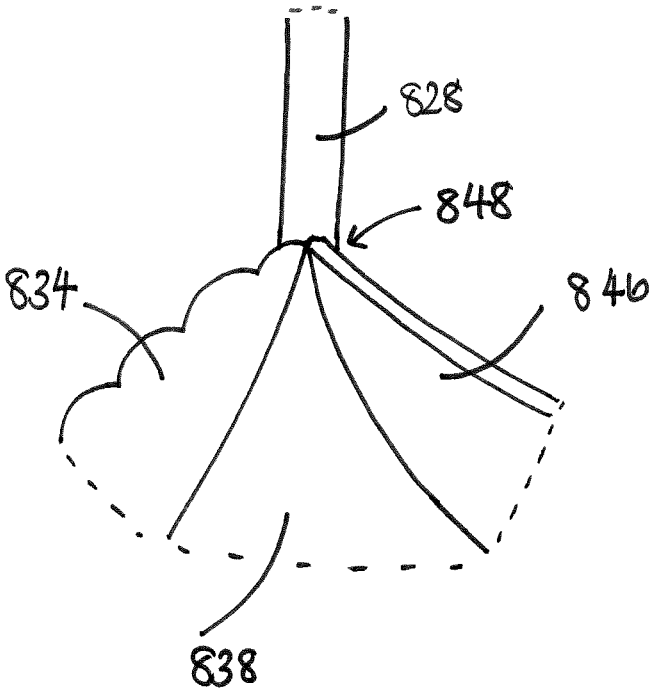
FIG. 13 illustrates the apex area in an alternative of the underwired brassiere of the present invention.

FIG. 13 illustrates apex 848 in an alternative of the underwired brassiere of the present invention and in particular that apex 848 forms a point wherein strap 828 connects to panel 834, panel 838 and control panel 846.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A brassiere comprising a wing having a top edge and a bottom edge, at least one strap and at least one cup for receiving a breast, the cup having an around cup edge section, an underarm edge section, a neckline edge section and an apex, the around cup section of the cup having a wire, wherein the brassiere further comprises a control panel generally extending from the apex of the cup into the wing, the control panel having an upper edge and a lower edge and wherein the wire terminates at one end proximal to the lower edge of the control panel, wherein the control panel comprises a first elastic strip which extends substantially along the lower edge of the control panel and which is configured to control the force of the one end of the wire towards the wing.

2. A brassiere as claimed in claim 1 wherein the distance between the upper edge and lower edge of the control panel is between about 2.5 cm to 8 cm.

3. A brassiere as claimed in claim 1 wherein the distance between the upper edge and lower edge of the control panel is between about 3 cm to 6 cm.

4. A brassiere as claimed in claim 1 wherein the distance between the upper edge and lower edge of the control panel is about 4 cm.

5. A brassiere as claimed in claim 1 wherein the distance between the upper edge and lower edge of the control panel is measured substantially vertically from a point where the one end of the wire terminates proximal to the lower edge of the control panel.

6. A brassiere as claimed in claim 1 wherein the control panel is elasticated.

7. A brassiere as claimed in claim 1 wherein the first elastic strip is configured to control the force of the one end of the wire towards the wing and away from the apex.

8. A brassiere as claimed in claim 1 wherein the first elastic strip extends substantially across a point where the one end of the wire terminates.

9. A brassiere as claimed in claim 8 wherein the first elastic strip extends substantially from the apex of the cup to the bottom edge or around the wing.

10. A brassiere as claimed in claim 1 wherein the first elastic strip extends substantially from the one end of the wire to the bottom edge or around the wing.

11. A brassiere as claimed in claim 1 wherein the control panel comprises a second elastic material strip extending substantially from the apex of the cup along the underarm edge section of the cup to the top edge of the wing.

12. A brassiere as claimed in claim 1 wherein the control panel comprises a second elastic material strip extending substantially along the upper edge of the control panel.

13. A brassiere as claimed in claim 1 wherein the strap is connectable to the cup.

14. A brassiere as claimed in claim 13 wherein the strap is connectable to the apex of the cup.

* * * * *